US005460671A

United States Patent [19]

Khandhadia

[11] Patent Number: 5,460,671

[45] Date of Patent: Oct. 24, 1995

[54] IGNITION COMPOSITIONS FOR INFLATOR GAS GENERATORS

[75] Inventor: Paresh S. Khandhadia, Rochester Hills, Mich.

[73] Assignee: Automotive Systems Laboratory, Inc., Farmington Hills, Mich.

[21] Appl. No.: 405,384

[22] Filed: Mar. 15, 1995

Related U.S. Application Data

[62] Division of Ser. No. 222,543, Apr. 4, 1994, abandoned.

[51] Int. Cl.[6] ..... C06B 21/00

[52] U.S. Cl. ..... 149/109.6; 102/205; 149/19.7; 149/83; 280/741

[58] Field of Search ..... 149/19.7, 83, 109.6; 102/205; 280/741

[56] References Cited

U.S. PATENT DOCUMENTS

| | | | |
|---|---|---|---|
| 610,417 | 9/1898 | Singleton | 149/83 |
| 739,356 | 9/1903 | Spore | 149/83 |
| 858,874 | 7/1907 | Kline | 149/83 |
| 885,689 | 4/1908 | Grande | 149/83 |
| 975,030 | 11/1910 | Gray | 149/83 |
| 1,214,766 | 2/1917 | Donner | 149/83 |
| 2,496,815 | 2/1950 | Ringer | 149/83 |
| 3,773,351 | 11/1973 | Cafanzarite | 280/738 |
| 3,862,866 | 1/1975 | Timmerman et al. | 149/85 |
| 3,971,729 | 7/1976 | Timmerman | 149/83 |
| 4,032,374 | 6/1977 | Douda et al. | 149/83 |
| 4,101,291 | 7/1978 | Marion | 252/186.24 |
| 4,238,253 | 12/1980 | Garner | 149/83 |
| 4,303,413 | 12/1981 | Marion | 149/17 |
| 4,561,675 | 12/1985 | Adams et al. | 280/734 |
| 4,694,841 | 9/1987 | Esparza | 131/351 |
| 5,084,118 | 1/1992 | Poole | 149/22 |
| 5,100,170 | 3/1992 | Mihm et al. | 280/735 |

OTHER PUBLICATIONS

John A. Conkling, "The Reaction of Potassium Chlorate With Organic Fuels" at the 1984 Annual Meeting, Pyrotechnics and Explosives Applications Section, sponsored by American Defense Preparedness Association, Oct. 23–25, 1984.

Hawley et al., *The Condensed Chemical Dictionary*, 9th Ed., p. 415, Van Nostrand Reinhold (1977) New York.

*Primary Examiner*—Edward A. Miller
*Attorney, Agent, or Firm*—Lyman R. Lyon

[57] ABSTRACT

Autoigniting compositions and processes for a gas generator of a vehicle occupant restraint system result in rapid autoignition at relatively low temperatures from approximately 135° C. to 210° C., thereby allowing the gas generator to operate at lower temperatures to facilitate use of an aluminum canister. The autoignition compositions of the present invention are safely manufactured by wet blending, remain effective following long-term high temperature ageing, and produce an energy output that is suitable for use with gas generating compositions.

4 Claims, No Drawings

IGNITION COMPOSITIONS FOR INFLATOR GAS GENERATORS

This is a divisional of application(s) Ser. No. 08/222,543 filed on Apr. 4, 1994, and abandoned.

BACKGROUND OF THE INVENTION

The present invention relates to ignition compositions, and more particularly to ignition compositions for inflator gas generators utilized in vehicle occupant restraint systems.

A steel canister is commonly utilized as the inflator pressure vessel for an automobile occupant restraint system because of the relatively high strength of steel at elevated temperatures. However, emphasis on vehicle weight reduction has renewed interest in the use of aluminum in place of steel in such pressure vessels.

One test that vehicle occupant restraint inflator systems must pass is exposure to fire whereupon the gas generating material of the inflator is expected to ignite and burn, but the inflator pressure vessel must not rupture or throw fragments. Steel pressure vessels pass this test relatively easily because steel retains most of its strength at ambient temperatures well above the temperature of which the gas generant autoignites. Aluminum, however, loses strength rapidly with increasing temperature and may not be able to withstand the combination of high ambient temperature and high internal temperature and pressure generated upon ignition of the gas generant. If, however, the gas generant of the inflator can be made to autoignite at relatively low temperatures, for example, 1350° C.(275° F.) to 210° C. (410° F.) the inflator canisters can be made of aluminum.

Providing autoignition compositions for use in aluminum pressure vessels has heretofore been problematic. U.S. Pat. No. 4,561,675 granted to Adams et al, which discloses the use of Dupont 3031 single base smokeless powder as an autoignition gas generant, is exemplary of an unreliable autoignition composition found in the prior art. While such smokeless powder autoignites at approximately the desired temperature of 177° C. (≈350° F.), it is largely composed of nitrocellulose. One of ordinary skill in the propellant field will appreciate that nitrocellulose is not stable for long periods at high temperatures, which is a specific requirement in automotive applications.

In addition, commonly assigned U.S. Pat. No. 5,084,118 to Poole, describes other autoignition compositions, which comprise 5-aminotetrazole, potassium or sodium chlorate, and 2,4-dinitrophenylhydrazine. While the compositions disclosed in U.S. Pat. No. 5,084,118 autoignite and cause ignition of the gas generant when heated to approximately 177° C. (≈350° F.), the compositions have not proven to be fully satisfactory. The manufacture of these compositions is difficult and hazardous because of the utilization of hexane and xylene in the manufacturing process. Hexane has a low boiling temperature and thus requires careful handling, while xylene is a suspected carcinogen. In addition, the compositions disclosed in U.S. Pat. No. 5,084,118 are not effective after long-term ageing. Vehicle occupant restraint inflator systems must pass ageing requirements in order to ensure reliable ignition despite exposure to a wide range of temperatures over the life of the vehicle.

SUMMARY OF THE INVENTION

The present invention solves the aforesaid problems by providing ignition compositions and processes comprising an oxidizer, such as potassium chlorate, wet mixed with a fuel comprising one or more carbohydrates. The ignition compositions are utilized in an automobile occupant restraint system and autoignite and cause ignition of the gas generant when heated to approximately 135° C. (≈275° F.) to 210° C. (≈410° F.), thereby permitting the use of an aluminum pressure vessel to contain the generant and gases produced by the generant. The ignition compositions of the present invention are relatively unaffected by long-term high temperature ageing, and do not utilize hazardous or carcinogenic solvents during manufacture. Further, the energy output of the ignition compositions of the present invention is suitably high for use with gas generating compositions in vehicle occupant restraint systems.

DETAILED DESCRIPTION OF THE PREFERRED EMBODIMENT(S)

The ignition compositions of the present invention comprise a mixture of an oxidizer and a fuel. The oxidizer is selected from the group consisting of alkali metal or alkaline earth metal chlorates or mixtures thereof, preferably potassium or sodium chlorate. In accordance with the present invention, potassium chlorate ($KClO_3$) is rich in oxygen, containing 39.17% oxygen by weight, and is very reactive and receptive to propagative burning. Potassium chlorate is preferred over less sensitive oxidizers, such as potassium perchlorate, ammonium perchlorate, sodium nitrate, and potassium nitrate, which are not reactive enough to result in a quick autoignition.

In further accordance with the present invention, the ignition compositions comprise the aforesaid oxidizers in mixtures with fuels to provide autoignition temperatures of the ignition compositions which are sufficiently low, i.e., approximately 135° C. (275° F.) to 210° C. (410° F.), for suitable use in an aluminum pressure vessel. Mixtures of potassium chlorate with most organic fuels exhibit undesirably high ignition temperatures and cannot be utilized in an aluminum pressure vessel. However, low-melting, readily decomposed organic fuels are more reactive with potassium chlorate, have much lower autoignition temperatures, and are appropriate for use in aluminum pressure vessels.

More specifically, the low-melting, readily decomposed organic fuels are selected from the group consisting of one or more carbohydrates. Because of the low decomposition temperatures exhibited by carbohydrates, mixtures of potassium chlorate with one or more carbohydrates provide an autoignition temperature between approximately 135° C. (275° F.) and 210° C. (410° F.). For example, monosaccharides such as D-glucose, D-galactose, D-ribose, pyruvic acid, or ascorbic acid are effective fuels, but disaccharides and polysaccharides may also be utilized. Preferably, potassium chlorate is selected as the oxidizer, and is present in a concentration of from about 60% by weight to about 85% by weight, while D-glucose or D-galactose is chosen as the fuel, and is present in a concentration of from about 15% by weight to about 40% by weight.

Exemplary of a combustion reaction of an oxidizer, such as potassium chlorate, and a carbohydrate, such as D-ribose, is as follows:

$$3C_5H_{10}O_5+10KClO_3 \rightarrow 10KCl+15H_2O+15CO_2$$

Similarly, the combustion reaction of potassium chlorate with an alternative fuel, such as ascorbic acid, is as follows:

$$3C_6H_8O_6+10KClO_3 \rightarrow 10KCl+18CO_2+12H_2O$$

It is noted that whereas carbohydrates are effective fuels in mixtures with the aforesaid oxidizers, sulfur is not a practical fuel for use in an ignition composition, in accordance with the present invention. A mixture of sulfur and potassium chlorate is an extremely unstable explosive, is very dangerous, has a very low decomposition temperature of about 100° C. (212° F.) to 110° C. (230° F.), and is thus ineffective as an ignition composition for inflator gas generators.

Further, despite the explosive dangers associated with even diluted mixtures of potassium chlorate and organic fuels, the compositions of the present invention are inherently safe while also achieving appropriate autoignition temperatures. More specifically, in accordance with the present invention, the ignition compositions are manufactured by a wet process that utilizes water, ethyl alcohol, or mixtures thereof, as described in the EXAMPLES hereinbelow. Thus, accidental ignitions are eliminated while relatively low autoignition temperatures are produced. The compositions of the present invention further increase manufacturing safety by eliminating the use of toxic solvents such as hexane and xylene during the manufacturing process.

In operation, the relatively low autoignition temperatures, i.e., approximately 135° C. (≈275° F.) to 210° C. (410° F.), produced by the compositions of the present invention are maintained following long-term high temperature ageing, for example after 400 hours at 107° C. (≈224° F.). The ignition compositions of the present invention therefore ensure ignition reliability despite exposure to a wide range of temperatures over the life of a vehicle, which may be 10 or more years.

In addition, an effective energy output is another advantageous feature of the present invention. The ignition compositions have a calorific output that is sufficient for use with a gas generating composition in a vehicle occupant restraint system. In operation, the autoignition material must produce enough heat to raise a portion of the gas generating composition to the ignition temperature. The minimum energy output required varies depending upon the type and configuration of gas generating composition, but a calorific value of 800 calories per gram is typically effective and is surpassed by the compositions of the present invention.

The present invention is illustrated by the following representative examples. The following compositions are given in weight percent.

EXAMPLE 1

A mixture of D-glucose and potassium chlorate was prepared having the following composition: 26.9% D-glucose and 73.1% $KClO_3$.

Both of the raw materials were dried, and the potassium chlorate was ground in a ball mill. The oxidizer and fuel were then wet blended with an 80/20 mixture of water and alcohol in a planetary mixer. Next, the wet blend was granulated using a wide screen granulator, followed by drying the granulated material. The dry product was then sieved.

The granulated powder was tested on a differential scanning calorimeter (DSC), and the autoignition onset temperature was observed at 138.9° C. (≈282° F.). The calorific value was 880 calories per gram.

Following long-term high temperature ageing at 107° C. (≈225° F.) for 400 hours, the DSC showed an onset temperature of 145° C. (293° F.) with a weight loss of 0.1235%, and the calorific value was 902 calories per gram.

EXAMPLE 2

A mixture of D-glucose and potassium chlorate was prepared having the following composition: 15% D-glucose and 85% $KClO_3$.

The mixture was prepared as described in EXAMPLE 1. When the mixture was tested in a DSC, the autoignition temperature was observed at 133.0° C. (≈271° F.). Following long-term high temperature ageing at 107° C. for 400 hours, the mixture autoignited at 144.0° C. (≈291° F.), with a weight loss of 0.1235%.

EXAMPLE 3

A mixture of D-glucose and potassium chlorate was prepared having the following composition: 20% D-glucose and 80% potassium chlorate.

The mixture was prepared as described in EXAMPLE 1. When the mixture was tested in a DSC, the autoignition temperature was observed at 133.5° C. (≈272° F.). Following long-term high temperature ageing at 107° C. for 400 hours, the mixture autoignited at 140.0° C. (≈284° F.), with a weight loss of 0.1205%.

EXAMPLE 4

A mixture of 30% D-glucose and 70% $KClO_3$ was prepared and tested as described in EXAMPLE 1. The mixture autoignited and burned at a temperature of 135.0° C. (≈275° F.). Following long-term high temperature ageing for 400 hours at 107° C., the autoignition temperature was observed at 139.0° C. (≈282° F.), with a weight loss of 0.1078%.

EXAMPLE 5

A mixture of 40% D-glucose and 60% potassium chlorate was prepared and tested as described in EXAMPLE 1. The autoignition temperature was observed at 136.5° C. (≈278° F.). Following long-term high temperature ageing at 107° C. for 400 hours, the mixture autoignited at 136.5° C. (≈278° F.), with a weight loss of 0.1492%.

EXAMPLE 6

A mixture of 26.875% D-galactose and 73,125% potassium chlorate was prepared as described in EXAMPLE 1. When the mixed powder was tested in a DSC, the autoignition onset temperature was observed at 162° C. (≈324° F.), with a calorific value of 940 calories per gram. Following long-term high temperature ageing at 107° C. for 400 hours, the DSC showed an autoignition onset temperature of 149.0° C., with a weight loss of 0.1532%.

The results of the foregoing examples are summarized in the following tables.

TABLE I

| Example No. | D-Glucose (weight %) | Potassium Chlorate (weight %) | Autoignition Temperature (°C.) | Autoignition Temperature (°C.) After Ageing for 400 Hrs at 107° C. | Wt. Loss % |
|---|---|---|---|---|---|
| 1 | 26.9% | 73.1% | 138.9 | 145.0 | |
| 2 | 15% | 85% | 133.0 | 144.0 | 0.1235 |
| 3 | 20% | 80% | 133.5 | 140.0 | 0.1205 |
| 4 | 30% | 70% | 135.0 | 139.0 | 0.1078 |
| 5 | 40% | 60% | 136.5 | 136.5 | 0.1492 |

TABLE II

| Example No. | D-Galactose (weight %) | Potassium Chlorate (weight %) | Autoignition Temperature (°C.) | Autoignition Temperature (°C.) After Ageing for 400 Hrs at 107° C. | Wt. Loss % |
|---|---|---|---|---|---|
| 6 | 26.875% | 73.125% | 162.0 | 149.0 | 0.1532 |

While the preferred embodiment of the invention has been disclosed, it should be appreciated that the invention is susceptible of modification without departing from the scope of the following claims.

I claim:

1. A method of igniting a gas generating composition utilized in an inflator of a vehicle occupant restraint system comprising the steps of:

wet mixing an oxidizer selected from the group consisting of alkali metal chlorates, alkaline earth metal chlorates or mixtures thereof with a fuel selected from the group consisting of carbohydrates or mixtures thereof to form an autoignition composition, wherein the oxidizer and fuel are wet mixed in the presence of water, ethyl alcohol, or mixtures thereof;

drying the wet autoignition composition;

positioning the autoignition composition within the inflator proximate the gas generating composition; and selectively causing the dry autoignition composition to reach an autoignition point whereupon the autoignition composition ignites the gas generating composition.

2. The method of claim 1 wherein the inflator comprises a housing having at least a portion thereof formed from aluminum.

3. The method of claim 1 wherein the carbohydrate is selected from the group consisting of galactose, glucose, ribose, pyruvic acid, and ascorbic acid.

4. The method of claim 1 wherein said oxidizer is potassium chlorate.

* * * * *